US007018028B2

(12) United States Patent
Chou et al.

(10) Patent No.: US 7,018,028 B2
(45) Date of Patent: Mar. 28, 2006

(54) POROUS MATERIAL FOR CHANNELING INK IN AN INK CARTRIDGE AND METHOD FOR CHANNELING INK

(75) Inventors: Ching-yu Chou, Taipei (TW); Ying-ran Tseng, Hsinchu (TW)

(73) Assignee: Nano Dynamics Inc., Hsinchu (TW)

( * ) Notice: Subject to any disclaimer, the term of this patent is extended or adjusted under 35 U.S.C. 154(b) by 189 days.

(21) Appl. No.: 10/618,664

(22) Filed: Jul. 15, 2003

(65) Prior Publication Data

US 2004/0021749 A1 Feb. 5, 2004

(30) Foreign Application Priority Data

Jul. 19, 2002 (TW) ..... 91116071 A

(51) Int. Cl.
*B41J 2/175* (2006.01)

(52) U.S. Cl. ..... 347/86; 347/93

(58) Field of Classification Search ..... 347/85–87, 347/93; 141/18; 250/573
See application file for complete search history.

(56) References Cited

U.S. PATENT DOCUMENTS

| | | | | |
|---|---|---|---|---|
| 4,771,295 | A * | 9/1988 | Baker et al. | 347/87 |
| 5,886,721 | A * | 3/1999 | Fujii et al. | 347/87 |
| 6,099,114 | A * | 8/2000 | Sasaki | 347/86 |
| 6,145,974 | A * | 11/2000 | Shinada et al. | 347/87 |
| 6,270,207 | B1 * | 8/2001 | Sasaki | 347/86 |
| 6,595,711 | B1 * | 7/2003 | Hill | 400/470 |
| 6,736,496 | B1 * | 5/2004 | Hanaoka et al. | 347/86 |

* cited by examiner

*Primary Examiner*—Stephen Meier
*Assistant Examiner*—An H. Do
(74) *Attorney, Agent, or Firm*—Birch, Stewart, Kolasch & Birch, LLP

(57) ABSTRACT

A porous material for channeling ink in an ink cartridge and a method for channeling the ink includes a porous material housed in an ink compartment of the ink cartridge. The porous material includes a body which has a protruding portion located proximate at the bottom. The bottom surface is bucking the ink cartridge according to the required ink gathering location and is squeezed to form an ink gathering zone that has a higher porosity locally to channel ink movement and reduce residual ink.

12 Claims, 5 Drawing Sheets

POROUS MATERIAL FOR CHANNELING INK IN AN INK CARTRIDGE AND METHOD FOR CHANNELING INK

FIELD OF THE INVENTION

The present invention relates to ink cartridges and particularly to an ink channeling design for a porous material contained in an ink compartment of an ink cartridge to adsorb ink.

BACKGROUND OF THE INVENTION

Conventional ink cartridges for inkjet printers have an ink containing design which may be classified in three types: foam material, air bag and ink bag. Foam material has good space adaptability and is applicable even in a small space. It also is easy to install. Thus it has attracted a lot of interests in the industry.

Refer to FIG. 1 for the structure of a conventional ink cartridge that uses foam material. It includes a shell 1, a cap 2 located above the shell 1 and an inkjet head 3 located below the shell 1. The shell 1 has an ink compartment 4 to contain foam material 5 and ink. The inkjet head 3 has a boss 6 extending into the ink compartment 4. Conventional foam material 5 usually is a rectangular sponge squeezed into the ink compartment 4 from the upper side of the shell 1. The bottom of the foam material 5 is bucking against the boss 6 to raise actual porosity (PPI, pore/inch, as shown in FIG. 2) and increase the capillary force of the foam material 5 nearby the upper side of the boss 6 thereby to channel the ink contained in the foam material 5 to move towards the inkjet head 3 to supply the ink to the inkjet head for printing. Due to the height of the boss 6 is closely related to the porosity on the part section of the foam material 5, design of the boss 6 for different ink cartridges has to constantly test and modify the dimension of the boss 6 to enable the inkjet head 3 to form an optimal capillary force. However, the ink cartridge is formed by molding, every modification of the boss. 6 involves mold modifications. It is a time-consuming and tedious process. Design alteration is difficult. Moreover, while the design enables the capillary force of the foam material 3 decreasing gradually from the upper side of the boss 6 to the remote end and generates a desired ink channeling effect, the foam material 5 located away from the upper side of the boss 6 or on the lateral sides does not have desired distribution of capillary force as the foam material 5 located on the upper side of the boss 6. This is especially true for the foam material 5 abutting the lateral side of the boss 6. As the foam material 5 is stretched by the boss 6, the porosity drops significantly. As a result, the effect of capillary force also decreases. And the foam material 5 located on the lateral sides and remote from the boss 6 cannot channel the ink smoothly to the inkjet head 3. Hence residual ink tends to occur to the foam material 5 on the lateral and remote sides.

Furthermore, put a rectangular sponge respectively in two ink cartridges, one having the boss 6 extended into the ink compartment 4 and another without the boss 6 extending into the ink compartment 4, the test results of the residual ink are as follows:

| | Boss extended into the ink compartment | | Boss without extending into the ink compartment | |
|---|---|---|---|---|
| Compression ratio of foam (Times) | 2.5 | 3.0 | 2.5 | 3.0 |
| Ink contents (C.C.) | 38.21 | 41.5 | 38.46 | 40.6 |
| Residual ink (C.C.) | 10.12 | 10.53 | 20.0 | 23.12 |
| Residual ink ratio (%) | 26.5 | 25.4 | 52.0 | 56.9 |

The results lists above indicate that with the boss 6 extended into the ink compartment 4, residual ink ratio is about 26%, while the residual ink ratio is 55% when the boss 6 is not extended into the ink compartment 4. It is obvious that the design of having the boss 6 extended into the ink compartment 4 can reduce the residual ink ratio.

Although the boss 6 can help to reduce residual ink ratio, design alteration involves mold modifications. Thus design alteration is difficult. Moreover, the foam material 5 on the lateral sides of the boss 6 tends to be stretched by the boss 6 and results in decreasing of porosity and disruption of the capillary force, residual ink forms in the disrupted area. Therefore there is still room for improvement regard the techniques to reduce residual ink.

SUMMARY OF THE INVENTION

The primary object of the invention is to provide a porous material structure that is designed with a protrusive bottom to be squeezed by the ink cartridge when housed in an ink compartment to form an ink gathering zone that has a greater porosity locally. Thereby a greater capillary force is generated to channel the ink contained in the porous material to move towards the ink gathering zone at the bottom of the porous material. Disruption of the capillary force in some areas of the foam material may be prevented. As a result, residual ink may be reduced, and design and mass production adaptability may be enhanced.

Another object of the invention is to provide an ink channeling method for ink cartridges. A porous material is provided that has a protrusive bottom to be squeezed by the ink cartridge when housed in an ink compartment to form an ink gathering zone at the bottom of the porous material that has a greater porosity locally. Thereby a greater capillary force is generated to channel the ink contained in the porous material to move towards the ink gathering zone at the bottom of the porous material. Disruption of the capillary force in some areas of the foam material may be prevented. As a result, residual ink may be reduced, and design and mass production adaptability may be enhanced.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 2:
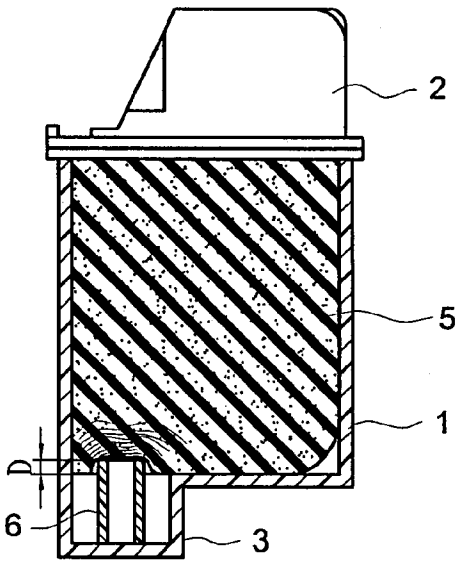
Fig. 2 PRIOR ART
FIG. 2 is a sectional view of FIG. 1.
Figure 1:
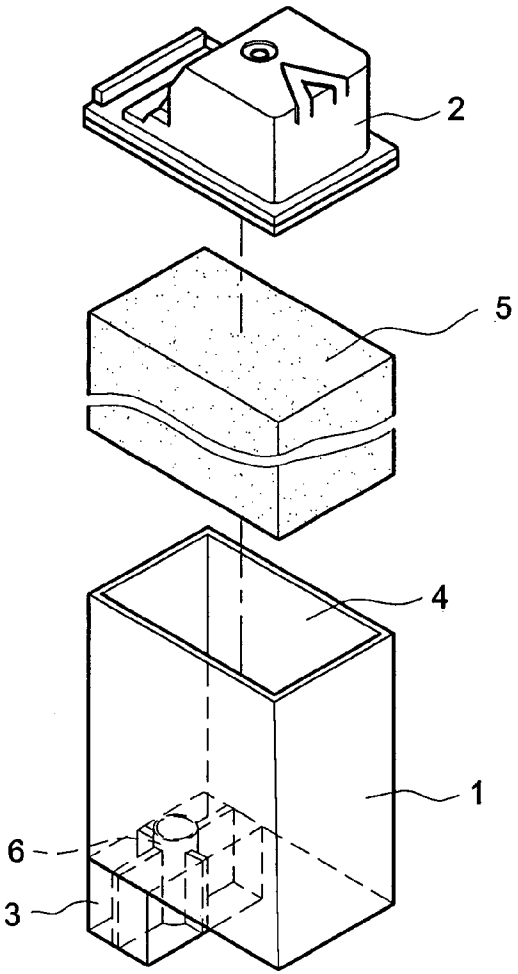
Fig. 1 PRIOR ART
FIG. 1 is an exploded view of a conventional ink cartridge using foam material.
Figure 4:
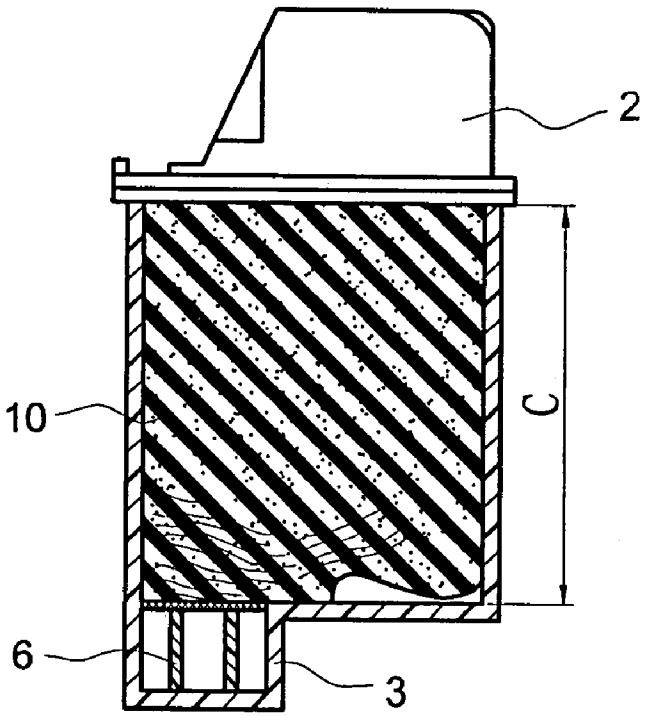
FIG. 4 is a schematic view of the invention with the porous material contained in the ink cartridge.
Figure 3:
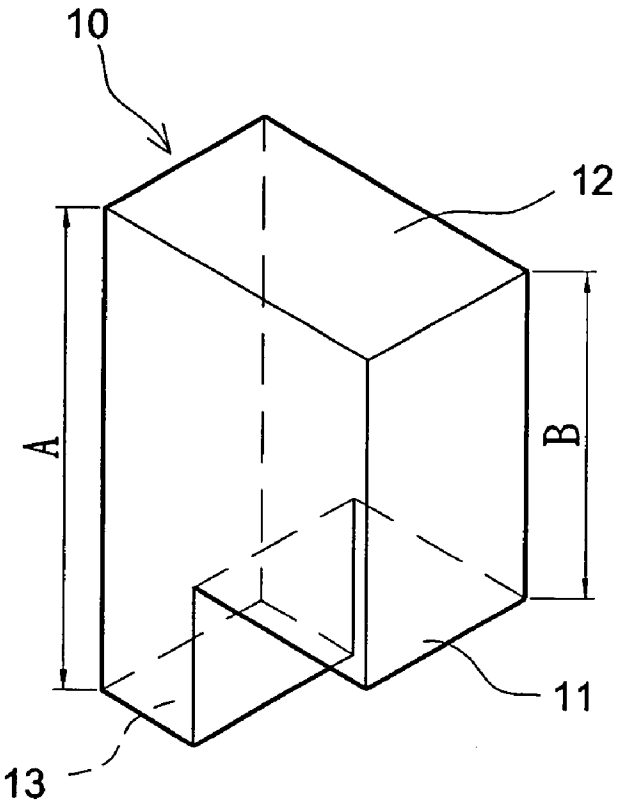
FIG. 3 is a schematic view of a first embodiment of the porous material structure of the invention.
Figure 5:
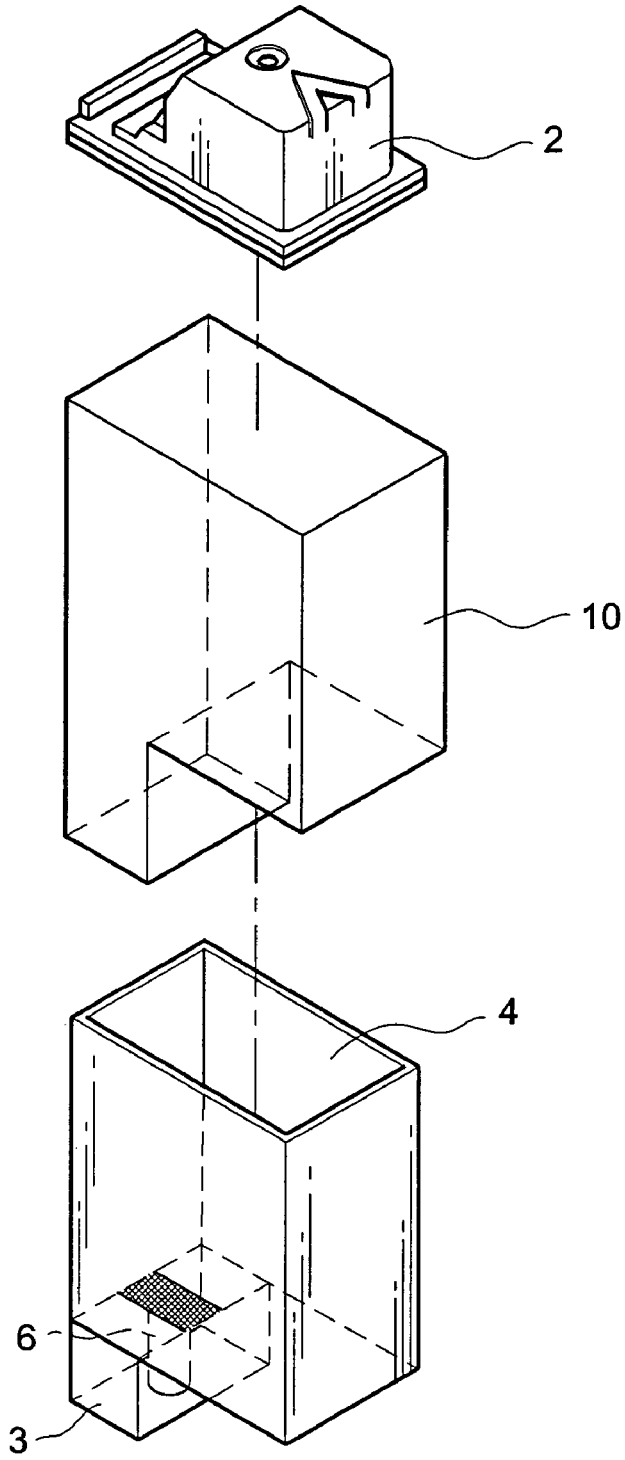
FIG. 5 is an exploded view of the porous material and the ink cartridge of the invention.

Referring to FIGS. 3, 4 and 5, the porous material 10 of the invention is contained in an ink compartment 4 of an ink cartridge. The porous material 10 includes a body 11, a top surface 12 and a bottom surface 13 smaller than the top surface 12. The bottom surface 13 is bucking against an inkjet head 3 of the ink cartridge.

Referring to FIGS. 4 and 5, the porous material 10 is placed in an ink cartridge which includes an inkjet head 3 with a boss 6 not extending into the ink compartment 4. Its bottom surface 13 is bucking against the boss 6 of the inkjet head 3. The height (A) of one side of the body 11 is greater than the height (B) of another side so that it can generate a greater compression ratio when bucking against the boss 6. The height (A) is the height between the top surface 12 and the bottom surface 13. The height (B) of the body 11 is greater than the height (C) of the ink cartridge. After the porous material 10 has been squeezed into the ink compartment 4, a cap 2 is coupled on the top end of the ink cartridge to seal the ink compartment 4 and to compress the height (A) and (B) of the porous material 10 to the height of the ink cartridge (C). As the height (A) is greater than height (B), and the bottom surface 13 is smaller than the top surface 12, the bottom surface 13 will form a greater porosity.

By means of the structure and shape of the porous material 10 set forth above, the bottom surface 13 forms a greater porosity on the bottom surface 13 and results in a greater capillary force to channel the ink contained in the porous material 10 to move in the direction of the inkjet head 3 thereby reduce residual ink. Compared with conventional techniques that resort altering the height of the boss 6 extended into the ink compartment 4 to change the porosity of the porous material 10, the invention does not have to modify the molds. By merely changing the shape of the porous material 10 to fit the ink cartridge, a required compression ratio may be achieved. Thus it has a greater adaptability for mass production.

Figures 6, 7, 8:
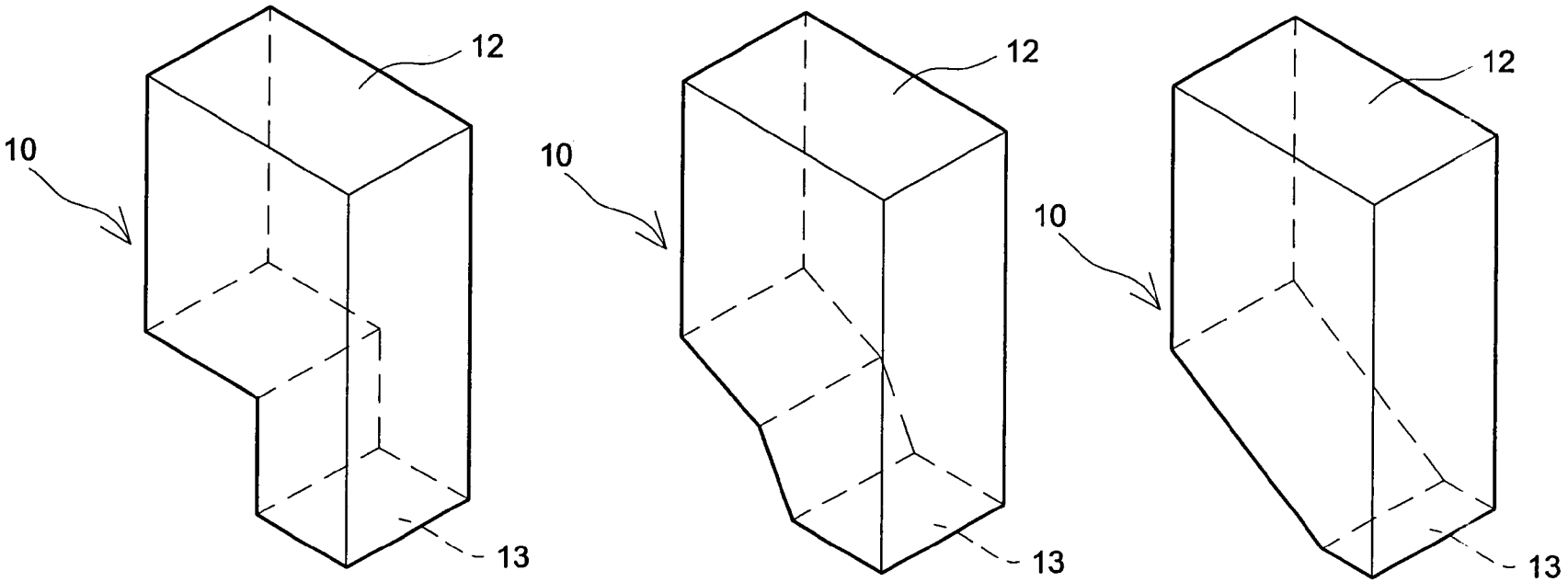
FIG. 6 is a schematic view of a second embodiment of the porous material structure of the invention.
FIG. 7 is a schematic view of a third embodiment of the porous structure material of the invention.
FIG. 8 is a schematic view of a fourth embodiment of the porous material structure of the invention.
Figure 11:
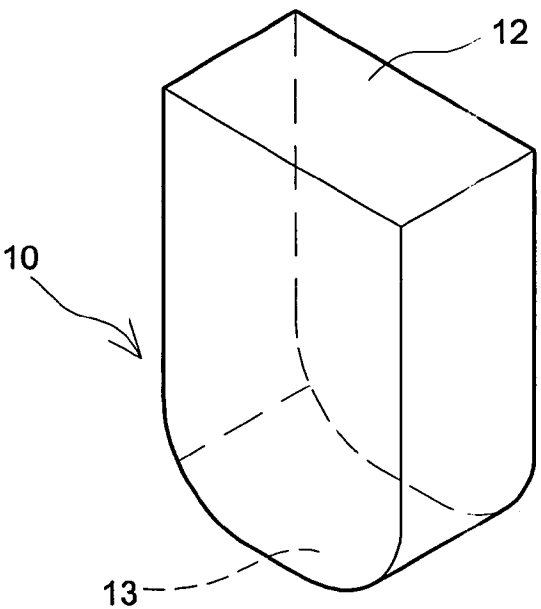
FIG. 11 is a schematic view of a seventh embodiment of the porous material structure of the invention.
Figure 10:
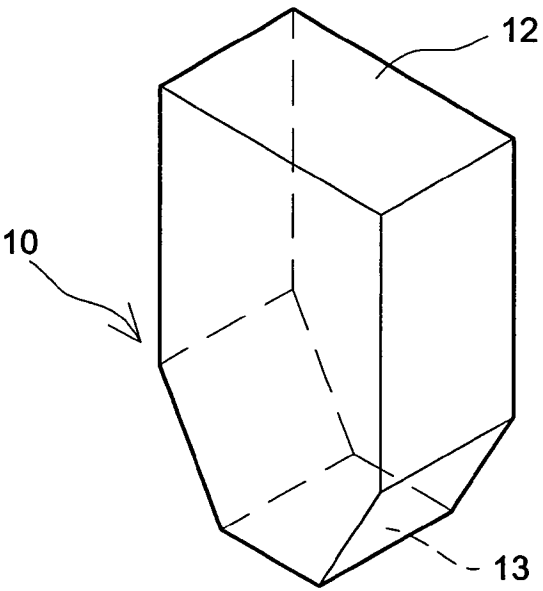
FIG. 10 is a schematic view of a sixth embodiment of the porous material structure of the invention.
Figure 9:
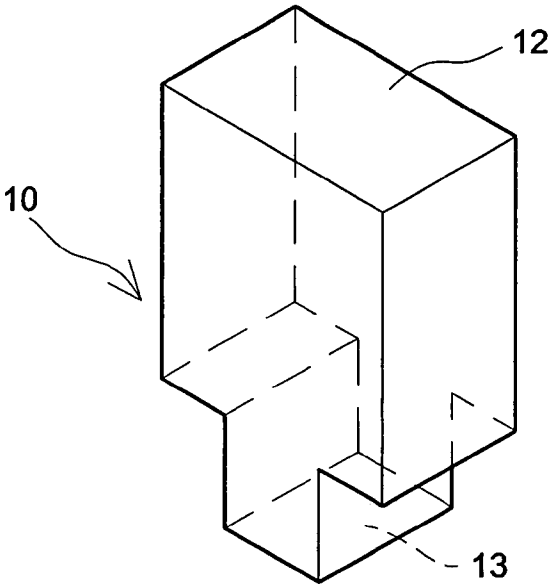
FIG. 9 is a schematic view of a fifth embodiment of the porous material structure of the invention.

Since the structures of the ink cartridge on the market are different, the location of the bottom surface 13 of the body 11 of the porous material 10 also has to be designed according to the location of the inkjet head 3. The shape may be any desirable geometric shapes. For instance, for the inkjet head 3 located on one side, the shape of the porous material 10 may consist of rectangular elements and be formed stepwise (as shown in FIGS. 6 and 7), or a trapezoid (as shown in FIG. 8), or the like. When the inkjet head 3 is located in the center, the porous material 10 may consist of rectangular elements and be formed in stepwise (as shown in FIG. 9), a wedge shape (as shown in FIG. 10) or U-shape (as shown in FIG. 11).

With the porous material 10 made according to the structure shown in FIG. 3 and the boss 6 not extending into the ink compartment 4 as shown in FIG. 4, test results for the relationship between the shape of the porous material and the residual ink are as follows:

| | | | | | | |
|---|---|---|---|---|---|---|
| Compression ratio of foam | 3 | 3 | 3.5 | 3.5 | 4 | 4 |
| Height A (MM) | 70 | 70 | 65 | 65 | 60 | 60 |
| Height B (MM) | 50 | 50 | 50 | 50 | 50 | 50 |
| Ink content (C.C.) | 29.4 | 28.87 | 29.38 | 29.34 | 29.4 | 29.4 |
| Residual ink (C.C) | 6.86 | 6.43 | 7.72 | 7.61 | 8.33 | 9.51 |
| Residual ink ratio (%) | 23.3 | 22.2 | 26.3 | 25.9 | 28.3 | 32.3 |

Based on the foregoing table, for the sponge compressed by 3 times with height (A) 70 mm and height (B) 50 mm, the residual ink ratio is about 23%. For the sponge compressed by 3.5 times with height (A) 65 mm and height (B) 50 mm, the residual ink ratio is about 26%. For the sponge compressed by 4 times with height (A) 60 mm and height (B) 50 mm, the residual ink ratio is about 30%. The ink cartridge that contains hydrophobic sponge at compressed by 3 times has residual ink ratio of 22–23%. Compared with conventional ones with the boss 6 not extending into the ink compartment 4, the ink residual ratio is about 55%. With the boss 6 extending into the ink compartment 4, the ink residual ratio is about 25.5%. It clearly shows that changing the shape of the porous material 10, especially the design of the ink cartridge, the ratio of the rear portion of the disrupted area and the ink cartridge may be reduced, and a desired capillary force distribution may be achieved. A greater capillary force is formed on the bottom surface 13 and decreases gradually towards the remote end. And during ink gathering process, disruption zones do not occur. This helps to reduce the residual ink.

Another test has been made based on the porous material 10 and ink cartridge. Test results are as follows:

Sponge material: PU foam with hydrophobic property

| | Present Invention | | Conventional | |
|---|---|---|---|---|
| Compression ratio | 4 | 3.5 | 4 | 4 |
| Height A (mm) | 60 | 60 | 50 | 50 |
| Height B (mm) | 50 | 50 | 50 | 50 |
| Boss height D (mm) | 0 | 0 | 2.5 | 1.5 |
| Ink content (C.C.) | 26.6 | 27.73 | 19.75 | 22.03 |
| Residual ink (C.C) | 6.65 | 6.03 | * | 8.7 |
| Residual ink ratio (%) | 25.0 | 21.7 | Ink leaking | 39.5 |

Based on the foregoing table, with the sponge made from PU foam with hydrophobic property and the sponge compressed by 4 or 3.5 times, for the invention with height (A) 60 mm and height (B) 50 mm, the residual ink ratio is about 23%. For the conventional ones that are 50 mm for the height (A) and (B), altering the height (D) of the boss 6 extending into the ink compartment 4 test results indicated that when (D) is 2.5 mm ink leakage occurs. When (D) is 1.5 mm, residual ink ratio is about 39.5%. It clearly shows that the invention can achieve improved residual ink.

Sponge material: PU foam with hydrophobic property

| | Present Invention | | Conventional |
|---|---|---|---|
| Compression multiple | 4 | 3.5 | 4 |
| Height A (mm) | 60 | 70 | 50 |
| Height B (mm) | 50 | 50 | 50 |
| Boss height D (mm) | 0 | 0 | 3 |
| Ink content (C.C.) | 29.11 | 29.33 | * |
| Residual ink (C.C) | 8.83 | 8.47 | * |
| Residual ink ratio (%) | 30.3 | 28.9 | No ink supply |

Based on the foregoing table, with the sponge made from. PU foam with hydrophilic property and the sponge compressed by 4 or 3.5 times, for the invention with height (A) 60 mm and height (B) 50 mm, or height (A) 70 mm and height (B) 50 mm, the residual ink ratio is about 29%. For the conventional one that is 50 mm for the height (A) and (B), altering the height (D) to 3 mm for the boss 6 extending into the ink compartment 4, ink supply is stopped.

In addition, the structure of the porous material 10 of the invention may also be adopted for the ink cartridge that has the boss 6 extended into the ink compartment 4. The porosity may in crease because of the height of the bottom surface 13 increases. In addition, the compression ratio increases because the bottom surface 13 is pressed by the boss 6. Thus whether the ink cartridge has the boss 6 extended into the ink compartment 4 or not, the porous material 10 of the invention may be used.

What is claimed is:

1. A porous material for channeling ink located in an ink compartment of an ink cartridge, characterized in a body which has a protrusive bottom surface squeezed by the ink cartridge, the squeezed protrusive bottom surface forming an ink gathering zone with a higher porosity than a remainder of the body, wherein the distance between a top surface and the bottom surface of the porous material is greater than the height of the ink cartridge.

2. The porous material of claim 1, wherein the bottom surface is located according to where an inkjet head is located.

3. The porous material of claim 1, wherein the body of the porous material consists of rectangular elements and is formed stepwise.

4. The porous material of claim 1, wherein the body of the porous material is selectively formed in a trapezoid, U-shape or a wedge shape.

5. An ink cartridge contained porous material comprising a porous material for containing ink, wherein the porous material has a body which has a protrusive bottom surface squeezed by the ink cartridge, the squeezed protrusive bottom surface forming an ink gathering zone with a higher porosity than a remainder of the body, wherein the distance between a top surface and the bottom surface of the porous material is greater than the height of the ink cartridge.

6. The ink cartridge of claim 5, wherein the bottom surface is located according to where an inkjet head is located.

7. The ink cartridge of claim 5, wherein the body of the porous material consists of rectangular elements and is formed stepwise.

8. The ink cartridge of claim 5, wherein the body of the porous material is selectively formed in a trapezoid, U-shape or a wedge shape.

9. A method for channeling ink in an ink cartridge through porous material, comprising steps of:

providing a porous material which has a body, the body having a protrusive bottom surface; and housing the porous material in the ink cartridge to contain ink, the protrusive bottom surface being squeezed by the ink cartridge so that the protrusive bottom surface forms an ink gathering zone with a higher porosity than a remainder of the body to distribute capillary force such that the capillary force decreases gradually from the protrusive bottom surface to remote ends and the ink in the ink cartridge converges to the ink gathering zone because of the distribution of the capillary force, wherein the distance between a top surface and the bottom surface of the porous material is greater than the height of the ink cartridge.

10. The method of claim 9, wherein the bottom surface is located according to where an inkjet head is positioned.

11. The method of claim 9, wherein the body of the porous material consists of rectangular elements and is formed stepwise.

12. The method of claim 9, wherein the body of the porous material is selectively formed in a trapezoid, U-shape or a wedge shape.

* * * * *